US008111204B2

(12) United States Patent
Croman

(10) Patent No.: US 8,111,204 B2
(45) Date of Patent: Feb. 7, 2012

(54) SLOT ANTENNA FOR A CIRCUIT BOARD GROUND PLANE

(75) Inventor: Russell Croman, Austin, TX (US)

(73) Assignee: Silicon Laboratories Inc., Austin, TX (US)

( * ) Notice: Subject to any disclaimer, the term of this patent is extended or adjusted under 35 U.S.C. 154(b) by 734 days.

(21) Appl. No.: 12/012,061

(22) Filed: Jan. 31, 2008

(65) Prior Publication Data

US 2009/0195468 A1 Aug. 6, 2009

(51) Int. Cl.
*H01Q 13/10* (2006.01)

(52) U.S. Cl. ..... 343/767

(58) Field of Classification Search ..... 343/767, 343/702, 700 MS, 770, 829
See application file for complete search history.

(56) References Cited

U.S. PATENT DOCUMENTS

| | | | | |
|---|---|---|---|---|
| 6,466,176 | B1 * | 10/2002 | Maoz et al. | 343/767 |
| 7,489,276 | B2 * | 2/2009 | Qi et al. | 343/702 |
| 7,532,168 | B2 * | 5/2009 | Nakanishi et al. | 343/702 |
| 7,705,792 | B2 * | 4/2010 | Qi et al. | 343/702 |
| 7,796,090 | B2 * | 9/2010 | Minard et al. | 343/727 |
| 2008/0001837 | A1 * | 1/2008 | Liu | 343/767 |

OTHER PUBLICATIONS

John D. Krauss, et al., "Third Edition Antennas, for All Applications," Chapter 9, Slot, Patch and Horn Antennas, Nov. 12, 2001, pp. 304-330.

Silicon Labs, "Si4720/21 Broadcast FM Radio Transceiver for Portable Applications," Jan. 18, 2007, pp. 1-2.

* cited by examiner

*Primary Examiner* — Huedung Mancuso

(57) ABSTRACT

In one embodiment, the present invention includes a slot antenna that is formed on a ground plane of a circuit board. The slot antenna may be connected to radio circuitry adapted on the circuit board by way of a feedline, which is coupled to the radio circuitry and across a portion of the slot antenna.

21 Claims, 4 Drawing Sheets

SLOT ANTENNA FOR A CIRCUIT BOARD GROUND PLANE

BACKGROUND

In radio receivers and transmitters, an antenna is provided to enable transmission and reception by electromagnetic radiation of radio signals. Various types of antennas exist, with different antennas having advantages for given applications.

As an example, antennas such as monopole and dipole antennas may be formed using one or more wires (respectively) to enable both radio reception and transmission. A dipole antenna may typically include two conductors each having a length that is a quarter of a wavelength, i.e., $\lambda/4$, of a desired frequency of operation, in which the midpoint between the conductors is driven by a source to transmit radio frequency (RF) signals at the desired frequency. The conventional dipole antenna generally has a radiation pattern having two generally figure-eight-shaped electromagnetic fields extending around the conductors.

Other applications may use a monopole antenna in which a single conductor is present, along with a conductive plate such as a ground plane that may be adapted perpendicular with respect to the conductor. This type of antenna is driven between the conductive plate and the conductor. Such an antenna results in a resonant structure that generally acts as a half dipole.

Other implementations may use a non-resonant antenna, such as a so-called short monopole antenna, which can be used in a portable device. This short monopole antenna, which is typically formed using a wire, has an electrical length than can be much less than a quarter wavelength of a given radio frequency. However, design limitations exist on such an antenna. For example, the antenna must be distanced from a ground plane, as well as other circuitry of a circuit board that includes a radio receiver or transmitter, to avoid capacitively loading the antenna. Furthermore, performance is less than ideal with such an implementation. That is, because electromagnetic fields associated with the antenna will terminate at the ground plane, the wire antenna must be kept as far as possible from the ground plane. Thus with an integrated antenna on a circuit board, excessive space is consumed in keeping the wire antenna away from the ground plane. Even with such a design, performance is impacted by the relatively close proximity of the antenna to the ground plane.

SUMMARY OF THE INVENTION

Various embodiments may be used to provide a slot antenna for radio circuitry adapted on a circuit board or other substrate. In one such implementation, a circuit board includes a ground plane formed of a conductive material to receive return current from circuitry adapted on the circuit board. The slot antenna can be formed from a slot located within a portion of this ground plane. In contrast to the rest of the ground plane, the slot lacks the conductive material and is capable of transmitting and/or receiving radio frequency (RF) signals. To couple the slot antenna to RF circuitry, a feedline, formed of a conductive trace, extends across the slot and to the RF circuitry. As a result, during operation the feedline communicates RF signals to/from the RF circuit across the slot. More specifically, the RF signals travel around a perimeter of the slot on the ground plane to cause electromagnetic radiation.

Another aspect of the present invention is directed to a system that includes a radio transceiver and a circuit board on which the radio transceiver is adapted. The circuit board includes an integrated slot antenna formed of a slot within a portion of a ground plane of the circuit board that lacks conductive material. A feedline, which can be formed on the same layer as the ground plane, extends across the slot and to the radio transceiver. In this way, RF transmission and reception can occur without the need for an external antenna.

A still further aspect of the present invention is directed to an apparatus that includes a conductive substrate having a slot with a first end adjacent to the substrate periphery. The slot lacks the conductive material of the substrate and can be used as a radio antenna capable of receiving and/or transmitting RF signals. Still further, a feedline having a conductive trace is coupled between RF circuitry and a distal portion of the conductive substrate, where the feedline extends across a first end of the slot and communicates a current between the RF circuitry and the distal portion so that the current returns substantially around a perimeter of the slot on the conductive substrate.

DETAILED DESCRIPTION

In various embodiments, a slot antenna may be provided for use in radio receiver and/or transmitter applications. For example, in some implementations a slot antenna may be provided as part of a ground plane or other circuitry of a circuit board including an integrated radio transceiver, such as a frequency modulation (FM) transceiver. In some implementations the slot antenna may be used with a stand alone receiver or transmitter. In this way, the slot antenna may be made part of the ground plane, rather than conventional designs in which an antenna needs to avoid the ground plane. A slot antenna as used in different implementations may be an electrically short slot (i.e., having a length much less than $\lambda/2$). For example, in many implementations the slot may be between approximately $\lambda/10$-$\lambda/50$, although the scope of the present invention is not limited in this regard.

As will be described further below, various slot designs may be realized to provide an antenna capable of both transmission and reception of radio signals. Generally, a slot design may be realized such that at least a portion of the slot is located in close proximity to a periphery of the circuit board, and that the antenna is driven with a feedline at an end of the slot. In this way, currents fed to the antenna may travel a maximum length around the slot to a return, thus enhancing the generated or received electromagnetic fields.

While described herein in connection with an integrated circuit (IC) transceiver, the scope of the present invention is not limited in this regard and a slot antenna in accordance with an embodiment of the present invention may be used in connection with other radios. By providing a slot antenna, the need for a wire or other type of antenna is avoided, reducing costs and parts needed. Furthermore, as compared to an integrated antenna formed of a conductor, e.g., present on a circuit board, reduced area is consumed in realization of an integrated antenna, potentially reducing the total board real estate in the process.

Note that slot antennas in accordance with an embodiment of the present invention may be formed of a non-resonant structure, in contrast to conventional resonant slot antennas. That is, while resonant slot antennas are used in certain applications such as waveguides, these slot antennas are generally formed as a slot within a dedicated structure such as a metal plate, where the slot is sized to enable realization of a resonant frequency. Furthermore, the driving-point impedance of such a resonant slot antenna is substantially real at the frequency of operation, i.e., lacking any inductance or capacitance, in contrast to various embodiments as described below.

Figure 1:
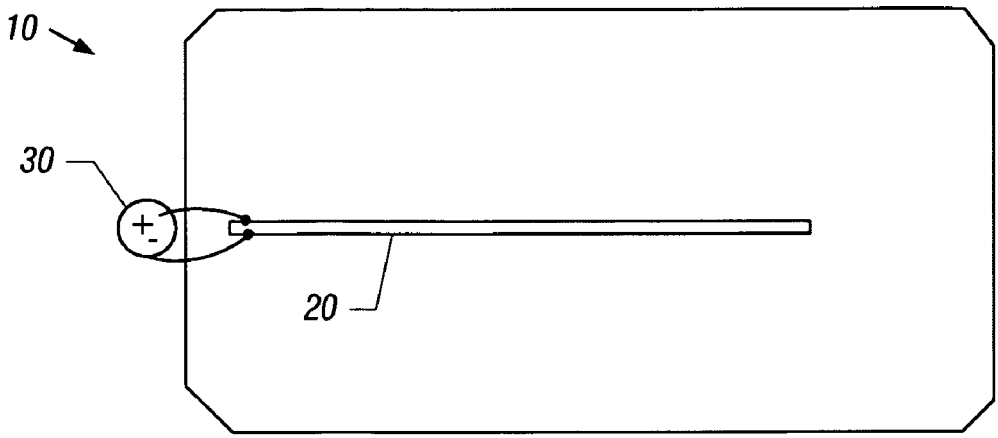
FIG. 1 is an illustration of a slot antenna in accordance with a first embodiment of the present invention.

Referring now to FIG. 1, shown is an illustration of a slot antenna in accordance with a first embodiment of the present invention. As shown in FIG. 1, a ground plane 10 which may be formed on one layer of a circuit board includes a slot antenna 20 which, as shown in FIG. 1, may be a substantially rectangular slot having a length much greater than its width. The slot lacks the conductive material of the ground plane layer. Ground plane 10 may be adapted to receive return current from various circuitry located on or within the circuit board. In some implementations, for example, in a ground plane having dimensions of between approximately 3-6 centimeters (cm) by approximately 8-10 cms, slot antenna 20 may be between approximately 3 and 5 cm's long and between approximately 0.1 and 0.5 centimeters wide. As shown in FIG. 1, a feedline 30 may be coupled to slot antenna 20. Note that feedline 30 may communicate across slot antenna 20. In the embodiment of FIG. 1, feedline 30 may correspond to board traces coupled to a transmitter, receiver, transceiver or so forth, and may be adapted on the same layer as ground plane 10. As shown in the embodiment of FIG. 1, slot antenna 20 may generally act as a short monopole, as feedline 30 is coupled at a substantial end portion of slot antenna 20.

However, with the geometry shown in FIG. 1, and particularly the location of slot antenna 20, board routing may become difficult, as generally few traces should cross slot antenna 20, to avoid unwanted radiation of signals and/or interference with the receiver, transceiver, etc. Other geometries or locations of slot antennas may be more feasible for a given board layout. Furthermore, the inductance that can be realized using a geometry such as that shown in FIG. 1 may be limited. While the scope of the present invention is not limited in this regard, in some implementations slot antenna 20 having a configuration such as that shown in FIG. 1 may have an inductance of between 20 nanoHenries (nH) and 50 nH.

Figure 2:
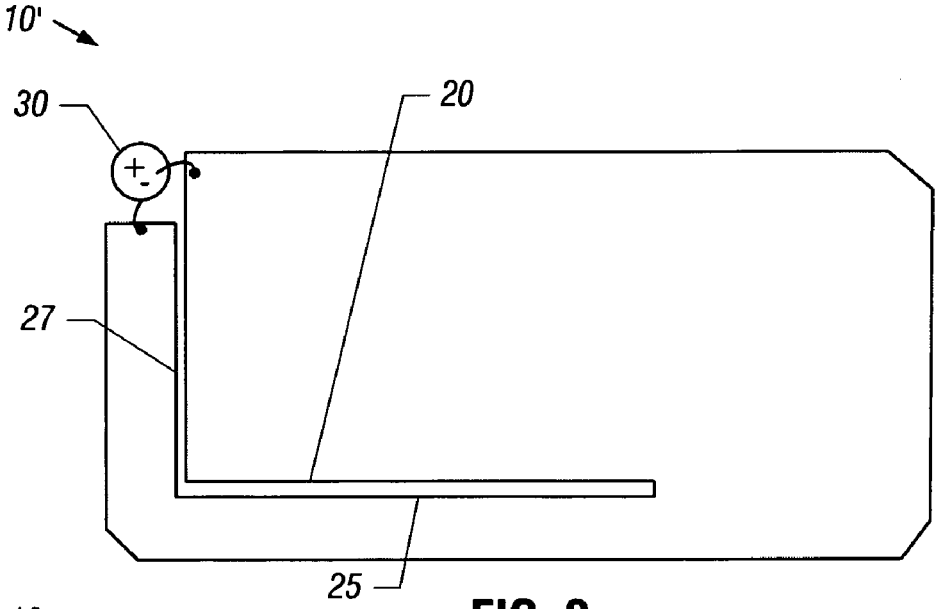
FIG. 2 is an illustration of a slot antenna in accordance with another embodiment of the present invention.

To provide an antenna with greater inductance capabilities, other geometries may be used. Referring now to FIG. 2, shown is an illustration of a slot antenna in accordance with another embodiment of the present invention. As shown in FIG. 2, a ground plane 10' includes a slot antenna 20. As shown in the embodiment of FIG. 2, slot antenna 20 may generally take the form of a right angle such that a first portion 25 extends in a first direction (i.e., horizontal), while a second portion 27 extends in a second direction (i.e., vertical), with feedline 30 driving a substantial end of second portion 27.

With the configuration shown in FIG. 2, very little board area is consumed and the need to extend traces across slot antenna 20 is minimized or avoided. As such, an efficient use of board space results. Note that in FIG. 2, the end of portion 27 adjacent to a periphery of ground plane 10' is open. This open-ended design enables improved radiation power for a given size of slot antenna 20.

Figure 3:
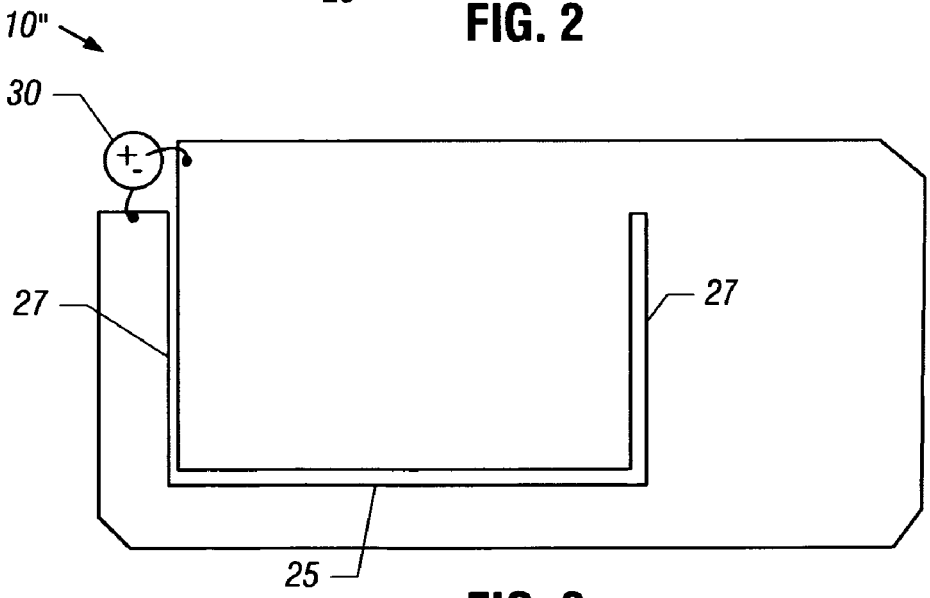
FIG. 3 is an illustration of a slot antenna in accordance with yet another embodiment of the present invention.

Still other configurations of a slot antenna are possible. Referring now to FIG. 3, shown is an illustration of a slot antenna in accordance with yet another embodiment of the present invention. As shown in FIG. 3, a ground plane 10" includes a slot antenna 20. As shown in the embodiment of FIG. 3, slot antenna 20 may include a pair of rectangular portions 27 in a first direction that are connected via a third rectangular portion 25 in a second direction, resulting in the configuration shown in FIG. 3. As with the embodiment of FIG. 2, slot antenna 20 may be driven with a feedline 30 at a substantial end of the first peripheral portion 27. A design such as that shown in FIG. 3 may have a greater inductance than the designs of FIGS. 1 and 2, in some implementations, and thus achieve a greater amount of radiated or received signals.

Of course, other implementations are possible. For example, a slot antenna may be adapted around other circuitry of a circuit board. For example, in some implementations a slot may be adapted substantially around a perimeter of a radiation cover, which may be used to shield noisy components from impacting other system components or vice-versa. Such a radiation shield or box may act as an extension of the ground plane and thus a slot may be adapted in close proximity to a perimeter of this shield to act as a slot antenna. In this way, when coupled with a feedline at one end of the slot, current may travel around the slot and return through the radiation shield, thus providing a suitable path for current travel and thus electromagnetic radiation in a desired radiation pattern.

Still further geometries are possible in other embodiments. As one example, a meandering geometry can be provided in which the slot antenna meanders through components present on a circuit board, e.g., of a cell phone. For example, the slot antenna may take various shapes including non-rectangular segments such as partially circular, snake-like or other non-regular geometries to configure the slot antenna around shield cavities and along limited available space on a circuit board.

Because a slot antenna may be electrically short, it may look primarily inductive at its feed point. To maximize radiated power of the slot antenna in a transmitter application, and to maximize the received signal strength in a receiver application, a matching network may be provided to impart a real impedance for a driver to drive, or to match the antenna to the load presented by a receiving circuit. Such a matching network may act to cancel the reactive component of the impedance seen by the driver, making the impedance appear real at the antenna feed point, and thus maximizing the transfer of power from the driver to the antenna or from the antenna to a receiving circuit. Thus embodiments may further provide a matching network to accommodate a given solution. For example, in some implementations an increased inductance may be added to enable the slot antenna to reach the tuning range of desired operation. Further, in an FM transceiver embodiment, a series inductance or a parallel capacitance may be coupled to the slot antenna to reach the tuning range of a controllable element of an driver. For example, the controllable element may be a tuning capacitance, such as one or more digitally controlled capacitor arrays to enable tuning to a desired channel.

More specifically, in some embodiments a slot antenna may provide an impedance of between approximately 50 nH and 100 nH, and more particularly approximately 70 nH, although the scope of the present invention is not limited in this regard. To increase the inductance to a desired level consistent with a tuning range of the oscillator, a tuning inductance may be provided, which is dependent upon the antenna inductor and desired frequency range to be tuned. In some implementations, the tuning inductor may enable the driver to see an inductance of approximately 120 nH.

Figure 4:
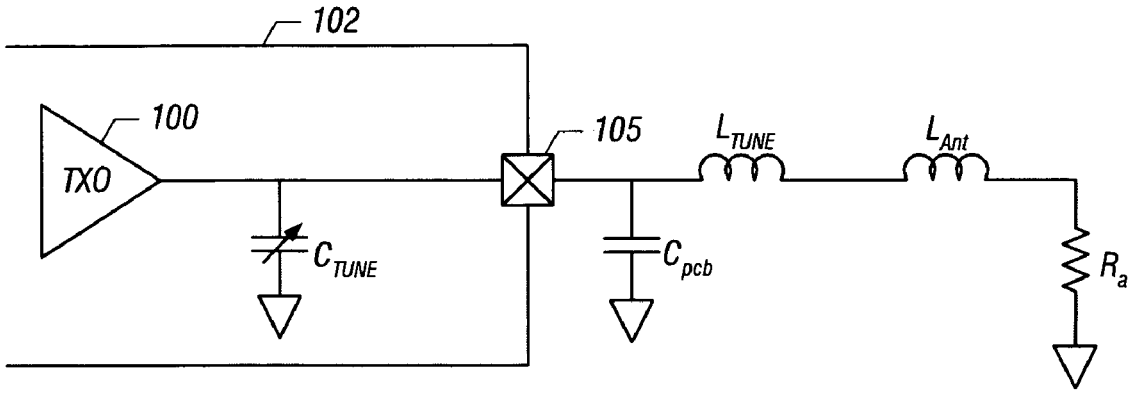
FIG. 4 is a circuit diagram in accordance with one embodiment of the present invention.

Referring now to FIG. 4, shown is a circuit diagram in accordance with one embodiment of the present invention. As shown in FIG. 4, circuit 100 generally shows a transmit chain of a radio in accordance with an embodiment of the present invention. As shown in FIG. 4, a transmitter 102, which may be a single chip transceiver, includes a driver 110 that provides a transmit output signal, TXO, which may be at a desired radio frequency, and which resonates at the radio frequency by means of a matching circuit including a controllable element, namely a tuning capacitance $C_{tune}$, which in one embodiment may be a digitally controlled capacitor array. As shown in FIG. 4, the RF signal may be provided on a pin 105 of transceiver 102. As shown in FIG. 4, pin 105 may be coupled to a tuning inductance $L_{tune}$ and a slot antenna (i.e., $L_{ant}$), which may be a slot antenna in accordance with an embodiment of the present invention. For example, assume a total inductance desired to be seen by the antenna of FIG. 4 is 120 nH, $L_{tune}$ may be set at a value to provide the difference between the inductance level of $L_{ant}$ and 120 nH. Thus, assuming that $L_{ant}$ has a value of 50 nH, $L_{tune}$ may be set at 70 nH. As shown in FIG. 4, a circuit board on which the tuning inductance and slot antenna are present may have a parasitic resistance $R_a$, which corresponds to radiation and loss resistance, and a parasitic capacitance ($C_{pcb}$).

Figure 5:
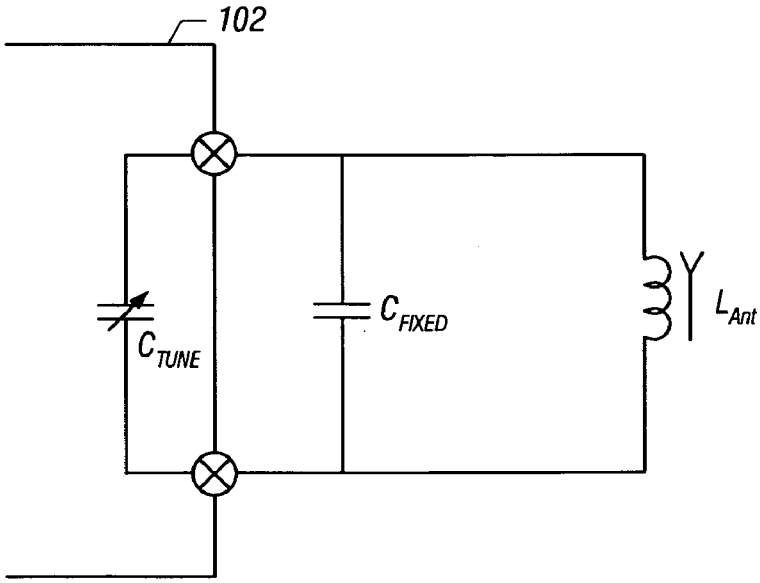
FIG. 5 is a circuit diagram in accordance with another embodiment of the present invention.

As mentioned above, in other implementations a tuning capacitance may be included to provide desired matching. Referring now to FIG. 5, shown is a circuit diagram in accordance with another embodiment of the present invention. As shown in FIG. 5, a tuning capacitance which may be a fixed capacitance ($C_{fixed}$) is coupled in parallel with slot antenna ($L_{ant}$) and the tuning capacitance ($C_{tune}$) of the frequency synthesizer of transceiver 102. While the scope of the present invention is not limited in this regard, in one embodiment the fixed capacitance may be approximately 20 picoFarads (pF). Furthermore, combinations of tuning inductances and capacitances may be present in some embodiments.

Of course, the values described above to provide matching may vary based on a given system in which an antenna is adapted. That is, a given transmitter, receiver, or transceiver may be coupled to an oscillator or other frequency synthesizer that has a tuning range centered about a predetermined frequency, e.g., a substantial midpoint of a selected radio band. For example, for FM band radio, such a controlled oscillator may have a tuning range set with a center value (corresponding to a midpoint control value for the oscillator) of approximately 90 MHz. Thus tuning inductances and/or capacitances may vary.

Figure 6A:
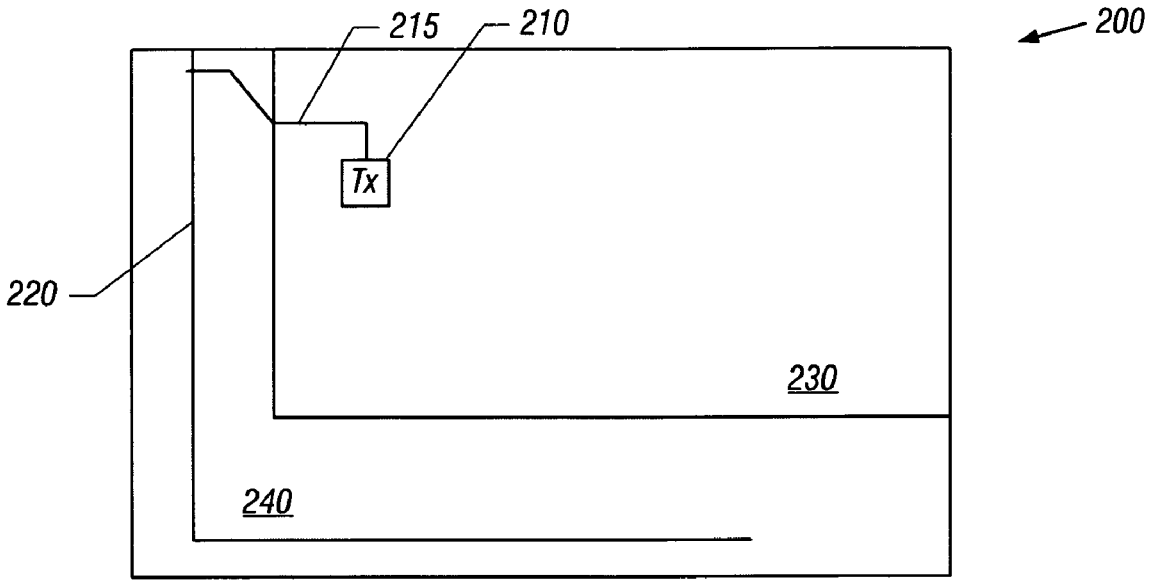
FIGS. 6A and 6B are illustrations of circuit boards using different integrated antennas.
Figure 6B:
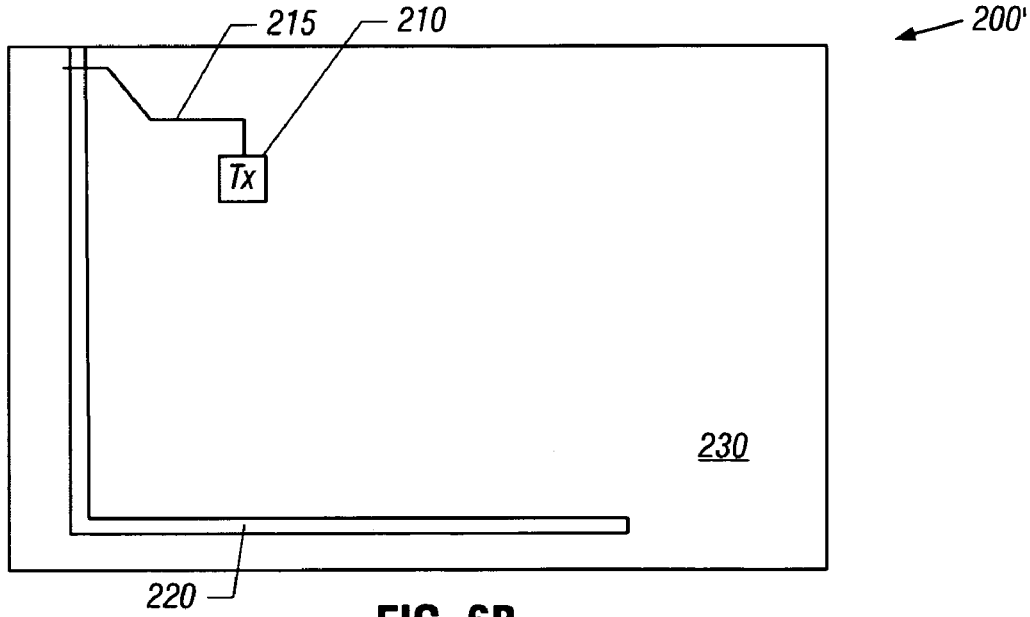

Thus using embodiments of the present invention, improved antenna performance may be realized, while simplifying board routing and potentially reducing board area. Referring now to FIGS. 6A and 6B, shown are illustrations of circuit boards using different integrated antennas. As shown in FIG. 6A, a circuit board 200 includes a radio transceiver 210 to which is coupled a trace 215 that in turn is coupled to a strip antenna 220, which may be an additional conductive trace or wire that acts as a short monopole antenna. Note that in the embodiment of FIG. 6A, a ground plane 230 is present. A buffer region 240, which extends to a periphery of circuit board 200, is located between strip antenna 220 and ground plane 230. Buffer region 240 may be a portion of the circuit board lacking any circuitry (i.e., not including any conductive material) and which is formed from epoxy or other dielectric material such as may be realized from prepreg sheets or other laminate materials used in forming layers of circuit board 200. Note this buffer region 240 thus acts to maintain as large a distance as possible between strip antenna 220 and ground plane 230, to avoid the interference of signal radiation by ground plane 230. While shown with only a single chip transceiver 210 in the embodiment of FIG. 6A, understand that various other components may be present, and circuit board 200 is shown with these limited features for ease of illustration.

Referring now to FIG. 6B, shown is layout of a circuit board 200' in accordance with an embodiment of the present invention. As shown in FIG. 6B, a transceiver 210 is coupled to a conductive trace 215, which traverses a slot antenna 220 at a substantial end thereof. Note that slot antenna 220 may correspond to a slot within ground plane 230 that lacks conductive material (and which may be located above board layers or material formed from like material as buffer region 240 of FIG. 6A). Thus in the embodiment of FIG. 6B, ground plane 230 extends around a full width of circuit board 200', improving electrical performance. Furthermore, the need for isolation (i.e., buffer region 240) between slot antenna 220 and ground plane 230 as present in FIG. 6A is avoided. In the embodiment of FIG. 6B, for signal transmission, transceiver 210 provides an RF signal along trace 215, which traverses slot antenna 220 at an end thereof, causing current to travel around the periphery of slot antenna 220 along ground plane 230, creating an electromagnetic field, thus enabling radiation of the RF signal. While shown with this particular implementation in the embodiment of FIG. 6B, the scope of the present invention is not limited in this regard, and other circuit board designs may include slot antennas having different configurations, different locations and so forth.

Figure 7:
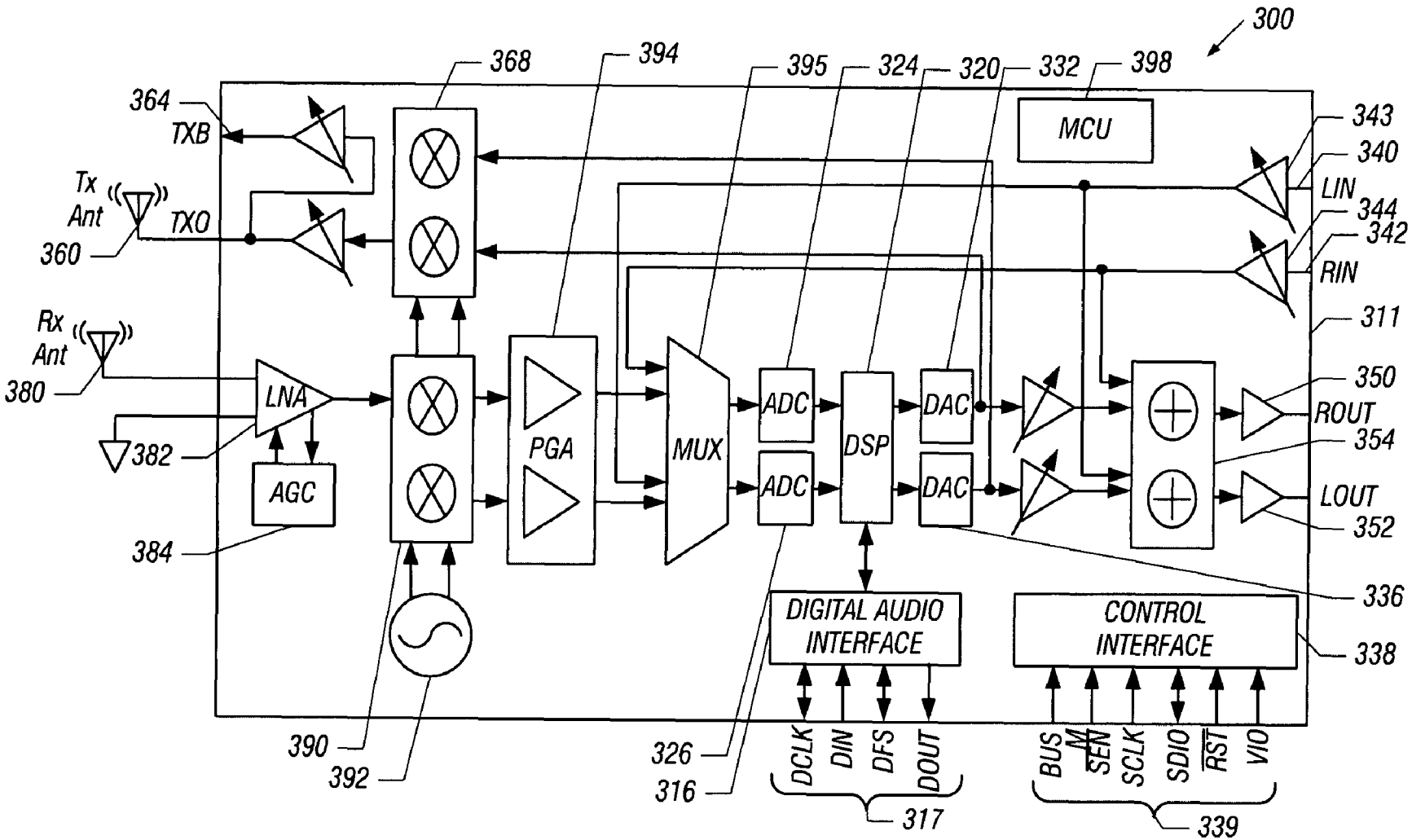
FIG. 7 is a block diagram of a transceiver in accordance with an embodiment of the present invention.

Embodiments may be implemented in connection with many different receivers, transmitters, transceivers and so forth. In some implementations, a radio transceiver capable of both AM and FM receive modes as well as at least an FM transmit mode may use a slot antenna as described herein. Referring now to FIG. 7, shown is a block diagram of a transceiver in accordance with an embodiment of the present invention. As shown in FIG. 7, a multimode combined AM/FM transceiver 300, which may be fabricated on a monolithic semiconductor die 311, has several different signal processing modes of operations, in which the transceiver 300 may perform FM transmission, AM or FM reception, analog mixing, digital mixing and codec functions. More specifically, as described herein, the multimode FM transceiver 300 has an FM transmit mode in which the transceiver 300 functions as an FM transmitter; an AM or FM receive mode in which the transceiver 300 functions as a receiver; and an audio mode in which the transceiver 300 functions as a codec. In each of these modes of operation, the multimode transceiver 300 may perform various analog and/or digital mixing functions. Additionally, in accordance with some embodiments of the invention, the multimode transceiver 300 includes a digital audio interface 316, which allows the communication of digital audio signals between the transceiver 300 and circuitry ("off-chip" circuitry, for example) that is external to the transceiver 300.

In general, the multimode transceiver 300 may receive one or more of the following input source signals in accordance with some embodiments of the invention: a digital audio (called "DIN"), which is received through the digital audio interface 316; an incoming RF signal that is received from an external receive antenna 380, which may be a slot antenna integrated on a circuit board on which transceiver 300 is adapted; a digital audio band signal that is received from the digital audio interface 316; and left channel (called "LIN") and right channel (called "RIN") analog stereo channel signals that are received at input terminals 340 and 342, respectively.

Depending on the particular configuration of the multimode transceiver 30, the transceiver 300 is capable of mixing two or more of its input source signals together to generate one or more of the following output signals: an outgoing FM transmission signal to drive an external transmit antenna 360, which may be the same integrated slot antenna as receive antenna 380 (note that a switch to control coupling of the antenna to receive and transmit paths is not shown for ease of illustration); left channel (called "LOUT") and right channel (called "ROUT") analog stereo signals that appear at output terminals 352 and 350, respectively; and a digital output signal (called "DOUT") that is routed through the digital audio interface 316. The multimode transceiver 300 may also provide a low impedance RF transmission output signal (called "TXB") at an output terminal 364 for purposes of driving a low impedance load.

As described herein, the multimode transceiver 300 may reuse some of its hardware components for purposes of reducing the complexity and size of the transceiver 300, as well as reducing the overall design time. For example, a digital signal processor (DSP) 320 of the multimode transceiver 300 performs both digital FM modulation (for the FM transmit mode) and digital AM and FM demodulation (for the receive mode) for the transceiver 300. As another example of the hardware reuse, analog-to-digital converters (ADCs) 324 and 326 of the multimode transceiver 300 perform transformations between the analog and digital domains for both complex (when the transceiver 300 is in the FM receive mode) and real (when the transceiver 300 is in the transmit modes) signals. Additionally, the ADCs 324 and 326 may be used in the audio mode for purposes of digitizing the LIN and RIN stereo channel signals.

As another example of hardware reuse by the multimode transceiver 300, in accordance with some embodiments of the invention, digital-to-analog converters (DACs) 332 and 336 of the transceiver 300 convert digital audio band signals from the digital to the analog domain for both the receive and audio modes. The DACs 332 and 336 are also used during the FM transmit mode for purposes of converting intermediate frequency (IF) band signals from the digital to the analog domain.

Turning now to the overall topology of the multimode transceiver 300, the transceiver 300 includes a multiplexer 395 for purposes of routing the appropriate analog signals to the ADCs 324 and 326 for conversion. For example, the multiplexer 395 may select an incoming analog IF signal during the receive mode and select the LIN and RIN stereo channel signals during the FM transmit and audio modes. The digital signals that are provided by the ADCs 324 and 326 are routed to the DSP 320.

For the receive modes, the multimode transceiver 300 includes analog mixers 390 that are coupled to a tunable local oscillator 392 (which may include a digitally controlled capacitor array or other controllable element), the frequency of which selects the desired radio channel to which the transceiver 300 is tuned. In response to the incoming RF signal, the mixers 390 produce corresponding analog IF, quadrature signals that pass through programmable gain amplifiers (PGAs) 394 before being routed to the ADCs 324 and 326. Thus, the ADCs 324 and 326 convert the analog IF quadrature signals from the PGAs 394 into digital signals, which are provided to the DSP 320. The DSP 320 demodulates the received complex signal to provide corresponding digital left and right channel stereo signals at its output terminals; and these digital stereo signals are converted into the analog counterparts by the DACs 332 and 336, respectively. As described further below, mixing may then be performed by mixers, or analog adders 354, which provide the ROUT and LOUT stereo signals at the output terminals 350 and 352, respectively. It is noted that the digital demodulated stereo signals may also be routed from the DSP 320 to the digital audio interface 316 to produce the DOUT digital signal.

In the FM transmit mode of the multimode transceiver 300, the content to be transmitted over the FM channel (selected by the frequency of the local oscillator 392, for example) may originate with the DIN digital data signal, the LIN and RIN stereo channel signals or a combination of these signals. Thus, depending on whether the analog signals communicate some or all of the transmitted content, the multimode transceiver 300 may use the ADCs 324 and 326. The DSP 320 performs FM modulation on the content to be transmitted over the FM channel to produce digital orthogonal FM signals, which are provided to the DACs 332 and 336 to produce corresponding analog orthogonal FM signals, which are in the IF range. Analog mixers 368 (which mix the analog orthogonal FM signals with a frequency that is selected by the local oscillator 392) frequency translate and combine the signals to produce an RF FM signal that is provided to the transmit antenna 360. In the audio mode of the multimode transceiver 300, the DSP 320 may be used to perform digital mixing. Analog mixing in the audio mode may be performed using the adder 354.

The transceiver 300 includes a control interface 338 for purposes of receiving various signals 339 that control the mode (FM transmit, AM or FM receive or audio) in which the transceiver 300 is operating, as well as the specific submode configuration for the mode, as further described below. For example, different firmware present in the DSP 320 may be executed based on the selected mode of operation. In accordance with some embodiments of the invention, the multimode FM transceiver 300 may also include a microcontroller unit (MCU) 398 that coordinates the general operations of the transceiver 300, such as configuring the ADCs 324 and 326 and DACs 332 and 336, configuring data flow through the multiplexer 395, performing blind scanning or the like.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A circuit board comprising:

a ground plane formed of a conductive material to receive return current from circuitry adapted on the circuit board, wherein a slot antenna is formed from a slot located within a portion of the ground plane, the slot lacking the conductive material, wherein the slot antenna is capable of transmission and/or reception of radio frequency (RF) signals; and a feedline formed of a conductive trace, the feedline extending across the slot and to a location on the circuit board at which an RF circuit is to be adapted, wherein the feedline is to communicate an RF signal from the RF circuit across the slot, wherein the RF signal is to travel around a perimeter of the slot on the ground plane to cause electromagnetic radiation of the RF signal, the slot antenna formed of a non-resonant structure.

2. The circuit board of claim 1, wherein the feedline is formed on a common layer with the ground plane.

3. The circuit board of claim 1, wherein the feedline is adapted across the slot substantially at an end of the slot, wherein the slot end is at a periphery of the circuit board.

4. The circuit board of claim 1, wherein the slot includes a first rectangular portion extending in a first direction and a second rectangular portion extending in a second direction substantially perpendicular to the first direction.

5. The circuit board of claim 4, wherein the first rectangular portion has a length substantially equal to a length of a first dimension of the circuit board.

6. The circuit board of claim 5, wherein a portion of the ground plane is adapted between the first and second rectangular portions and first and second edges of the circuit board, respectively.

7. The circuit board of claim 1, wherein the slot includes at least one non-rectangular segment, and wherein at least a portion of the slot meanders around a radiation shield adapted on the circuit board.

8. A system comprising:

a radio transceiver to transmit and receive radio frequency (RF) signals; and a circuit board on which the radio transceiver is adapted, wherein the circuit board includes an integrated slot antenna formed of a slot within a portion of a ground plane of the circuit board lacking conductive material, wherein the integrated slot antenna is capable of transmission and/or reception of radio frequency (RF) signals, the circuit board further including a feedline formed of a conductive trace, the feedline extending across the slot and to the radio transceiver, the feedline to communicate an RF signal from the radio transceiver across the slot and to the ground plane, wherein the RF signal current is to travel around a perimeter of the slot on the ground plane to cause electromagnetic radiation of the RF signal.

9. The system of claim 8, wherein the feedline is formed on a common layer with the ground plane.

10. The system of claim 9, wherein the slot includes a first rectangular portion extending in a first direction and a second rectangular portion extending in a second direction substantially perpendicular to the first direction.

11. The system of claim 10, wherein a portion of the ground plane is adapted between the first and second rectangular portions and first and second edges of the circuit board, respectively.

12. The system of claim 10, wherein the first rectangular portion has a length substantially equal to a length of a first dimension of the circuit board.

13. The system of claim 8, further comprising a radiation shield adapted around at least one component on the circuit board, wherein the slot is located substantially about a perimeter of and in close proximity to the radiation shield.

14. The system of claim 8, further comprising a matching network coupled to the integrated slot antenna to provide an impedance to maximize the radiated power of the integrated slot antenna.

15. The system of claim 8, further comprising a radiation shield adapted around at least one component on the circuit board, wherein the slot is located substantially about a perimeter of and in close proximity to the radiation shield.

16. An apparatus comprising:

a conductive substrate including a slot formed therein having a first end adjacent to a periphery of the conductive substrate, the slot lacking conductive material and corresponding to a radio antenna capable of receiving and transmitting radio frequency (RF) signals; and a feedline having a conductive trace coupled between RF circuitry and a distal portion of the conductive substrate, wherein the feedline is to communicate an RF signal from the RF circuitry across the slot, wherein the RF signal travels around a perimeter of the slot on the conductive substrate to cause electromagnetic radiation of the RF signal, the feedline extending across a first end of the slot and to communicate a current between the RF circuitry and the distal portion so that the current returns substantially around a perimeter of the slot on the conductive substrate.

17. The apparatus of claim 16, wherein the conductive substrate comprises a ground plane of a circuit board, wherein the circuit board includes a radio transceiver adapted thereon including the RF circuitry.

18. The apparatus of claim 17, further comprising an integrated circuit (IC) having a single substrate including the radio transceiver.

19. The apparatus of claim 17, further comprising a tuning inductance coupled in series between the feedline and the slot.

20. The apparatus of claim 19, wherein the radio transceiver includes a transmitter having a driver to transmit a RF signal at a selected frequency, the driver coupled to an antenna matching network including a controllable element coupled to the tuning inductance, wherein the antenna matching network is to impart a substantially real impedance to the driver.

21. The apparatus of claim 17, further comprising a radiation shield adapted around at least one component on the circuit board, wherein the slot is located substantially about a perimeter of and in close proximity to the radiation shield.

* * * * *